United States Patent [19]

Takamura et al.

[11] 4,090,873

[45] May 23, 1978

[54] PROCESS FOR PRODUCING CLAD METALS

[75] Inventors: Masayuki Takamura; Aritsune Matsuo; Kenzaburo Iijima, all of Hamamatsu, Japan

[73] Assignee: Nippon Gakki Seizo Kabushiki Kaisha, Shizuoka, Japan

[21] Appl. No.: 710,259

[22] Filed: Jul. 30, 1976

Related U.S. Application Data

[63] Continuation of Ser. No. 543,504, Jan. 23, 1975, abandoned.

[51] Int. Cl.[2] ..... B22F 7/04

[52] U.S. Cl. ..... 75/208 R; 75/214

[58] Field of Search ..... 75/214, 208 R

[56] References Cited

U.S. PATENT DOCUMENTS 3,753,704 8/1973 Manilla ..... 75/208 R

*Primary Examiner*—Brooks H. Hunt

*Attorney, Agent, or Firm*—Burgess, Ryan and Wayne

[57] ABSTRACT

Cladding materials in a substantially powdery state are laminated with a base material in a substantially solid state by compaction under static fluid pressure and thermal treatment for causing sintering of the cladding materials and mutual diffusion at the borders between the cladding material and the base material. The advantages and disadvantages of the component materials compensate each other.

24 Claims, 16 Drawing Figures

PROCESS FOR PRODUCING CLAD METALS

This is a continuation, division of application Ser. No. 543,504, filed Jan. 23, 1975 now abandoned.

The present invention relates to process for producing clad metals, and more particularly relates to a process for producing clad metals based on the use of cladding material or materials substantially in a powdery state in combination with compaction under static fluid pressure.

Clad metals, otherwise known as laminated metals, are generally produced by superimposing two or more different kinds of metal layers and binding them to each other by the application of pressure to the cladding surface or surfaces. The utility of such clad metals has been highly regarded in various fields of industry. This is because of the fact that, in the function of clad metals, disadvantages inherent in the respective component materials can well be compensated for by the advantages possessed by the respective component materials. The resultant properties of the clad metals are enhanced by the appropriate choice of the component materials used in the combination.

For example, when a clad metal is made up of copper and steel, the metal can exhibit excellent electro-conductivity caused by the copper content and this is accompanied with enhanced strength as spring material due to the steel content. A clad metal made up of a corrosion-resistant type 6053 aluminum alloy and a high-strength type 2024 aluminum alloy can be provided with high strength and resistance against corrosion. Further, a clad metal made up of copper and stainless steel can show appreciable thermal-conductivity accompanied with excellent resistance against corrosion.

Various systems have been proposed to bind the component materials by application of pressure to the cladding surface or surfaces.

One of the pressing systems is carried out by a pair of pairs of pressure rolls, where two or more sets of material layers are passed through the nip or nips between pressure rolls in a superimposed disposition. Although this pressing system is carried out with high productivity, there is a limitation to the choice of the combination of the component materials. The cladding surfaces of the component materials need to be treated in advance of the pressing by the rolls in a complicated manner, and the system is unsuitable for production of rod-shaped and tubular clad metals.

It is also known to produce clad metals by plating a base material wire with a cladding material, thermally treating the plated wire for mutual diffusion between the base and cladding materials and reducing the plated wire diameter by extrusion.

Although this system is suited for production of linear or tubular clad metals, the application is limited to the materials for which plating is employable. For example, this system cannot be used for most kinds of metallic alloy materials. Further, complicated control is necessary for the process of plating and the production cost of this system is very high.

Press binding by blasting is also known as one of the systems for producing clad metals. In this system, the cladding material layer is superimposed on the base material and explosive powders are deposited on the cladding material layer. By igniting the explosive powders, the cladding material is bonded to the base material. Although the binding between the material layers can be carried out in this system, there remains some difficulty as to the condition of the cladding surface due to the complicated metal flow at the surface. Further, this system entails relatively high production costs.

In addition, when compaction of powdery cladding material is carried out using rolls or extrusion die, the density of the cladding material tends to become higher at portions close to the rolls or die, and this local variance in the density tends to cause less uniformity in the thermal treatment effect. Further, the resultant average compaction ratio of the cladding material in the end product is very low being in a range from 50 to 70 assuming the compaction ratio of a perfectly solid body as equal to 100.

It is the principal object of the present invention to provide a process suited for production of clad metals of any desired shape and construction.

It is another object of the present invention to provide a process for producing clad metals wherein a free choice of component materials may be made.

It is a further object of the present invention to provide a process for producing clad metals with reduced production cost.

It is a further object of the present invention to provide a process for producing clad metals with ideal bonding between the component materials.

It is a further object of the present invention to provide a process for producing clad metals with increased and uniform compaction ratio of the cladding material or materials in the end product.

According to the basic concept of the present invention, a laminated body is prepared by covering a base material or materials substantially in a solid state with a cladding material or materials substantially in a powdery state. The laminated body is then subjected to binding by compaction under static fluid pressure such as hydrostatic pressure or static inert gas pressure. After the compaction, a thermal treatment or treatments are applied thereto in an atmosphere causing no oxidation in order to develop sintering of the cladding material or materials and concurrent mutual diffusion at the border or borders between the base and cladding materials. In the above-described process, the compaction should preferably be carried out at a static fluid pressure in a range from 1,500 to 20,000 kg/cm$^2$. Further, the thermal treatment should preferably be carried out at a temperature which is lower by 50° to 500° C than the lower melting point temperature of either of the materials.

Further features and advantages of the present invention will be made clearer from the following description, reference being made to the embodiments shown in the accompanying drawings, in which.

Figure 11:
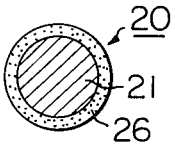
Figure 12:
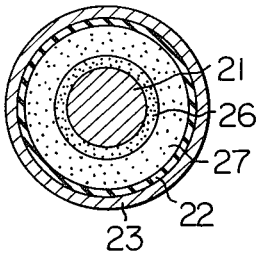
Figure 13:
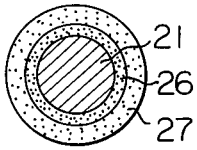
Figure 14:
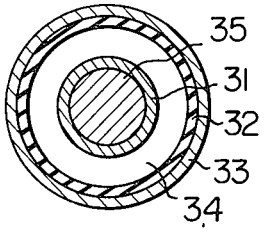
Figure 15:
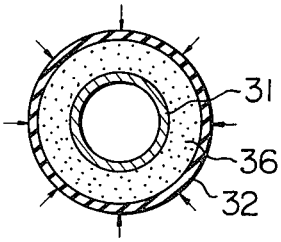
Figure 16:
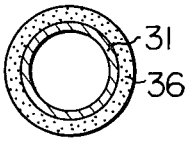

FIGS. 11 through 13 are transverse cross sectional plan views for showing process steps in further embodiments of the present invention, in which multi-laminated circular rod shaped clad metals are produced; and FIGS. 14 through 16 are transverse cross sectional plan views for showing process steps in a further embodiment of the present invention, in which a tubular-shaped clad material is produced.

An embodiment of the present invention is shown in FIGS. 1 through 5, in which the process of the present invention is applied to the production of a circular rod-shaped clad metal made up of a nickel-base alloy core and a copper sheath.

Figure 1:
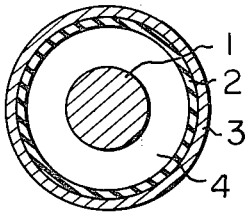
FIGS. 1 through 5 are transverse cross sectional plan views for showing process steps in one embodiment of the present invention, in which a circular rod shaped clad metal is produced.

A nickel-base alloy core 1 is encased and fixed in position within a rubber tube 2 and the latter is further covered with a back-up metal pipe 3, while leaving a cylindrical space 4 between the nickel-base alloy core 1 and the rubber tube 2 as shown in FIG. 1. Although the process of the present invention can be performed even without provision of the rubber tube 2, use of such a rubber tube 2 assures a uniform compaction of the powdery cladding component in the later static fluid pressure compaction stage. The back-up metal pipe 3 is used for prevention of undesirable stretching of the rubber tube 2 in the next stage wherein the sheath component powder fills the above-mentioned cylindrical space.

Figure 2:
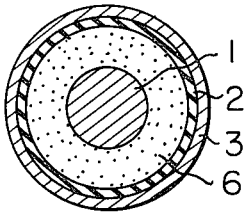

Next, as shown in FIG. 2, the cylindrical space 4 is filled up with the sheath cladding component 6 in a powdery state, i.e., copper powders in the present embodiment, at a compaction ratio in a range of 20 to 40, assuming that the compaction ratio of the perfectly solid body is 100.

Figure 3:
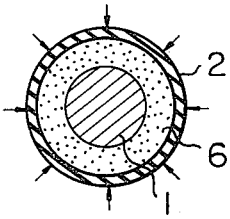

After filling-up of the sheath component, the back-up metal pipe 3 is removed and remaining entire body is subjected to a compaction by static fluid pressure, i.e., hydrostatic pressure in the present embodiment, the pressure amounting to about 6,000 kg/cm$^2$ as shown in FIG. 3. By this application of the static fluid pressure compaction, the compaction ratio of the powdery sheath cladding component 6 is raised up to a range of 80 to 90.

Figure 4:
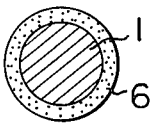

After completion of this compaction, the rubber tube 2 is removed as shown in FIG. 4 and the remaining entire body is then subjected to a thermal treatment at a temperature in a range from 500° to 1,000° C for about 1 to 20 hours. This application of the thermal treatment is intended to cause intering of the compacted powdery sheath component 6, i.e., the compacted copper powders, and concurrent mutual diffusion at the border between the core and sheath components, i.e., between the nickel-base alloy core 1 and the copper sheath 6. After this application of the thermal treatment, the compaction ratio of the powdery copper sheath component amounts to 90 to 100, and the bonding between the nickel-base alloy and the powdery copper is remarkably fortified by the above-described mutual diffusion at the border between the two components.

Figure 5:
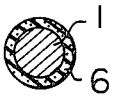

The clad metal rod so obtained is further processed in the usual operations such as repeated hydrostatic pressure extrusion, thermal treatments and drawings in order to be shaped into a rod body of prescribed dimension such as the one shown in FIG. 5.

Another embodiment of the present invention is shown in FIGS. 6 through 10, in which the process of the present invention is applied to the production of a plate-shaped clad metal made up of a nickel-base alloy base layer and a copper cladding layer.

Figure 6:
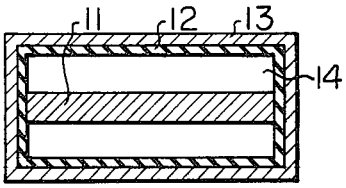
FIGS. 6 through 10 are transverse cross sectional plan views for showing process steps in the other embodiment of the present invention, in which a sheet-like clad metal is produced.

A nickel-base alloy base plate 11 is encased and fixed in position within a rubber casing 12, and the latter is further covered with a back-up metal box 13, while leaving spaces 14 on both sides thereof as shown in FIG. 6. As in the foregoing embodiment, it is preferable to use the rubber casing 12 in order to obtain uniform compaction of the powdery cladding component in the later staged static fluid pressure compaction while the use of the back-up metal box 13 effectively prevents undesirable stretching of the rubber casing 12 in the next stage wherein the cladding component powder fills the casing 12.

Figure 7:
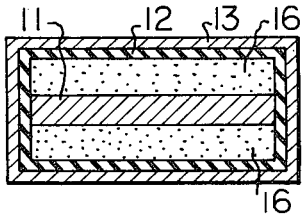

Next, as shown in FIG. 7, the spaces 14 on both sides of the base plate 11 are filled up with the cladding component 16 in a powdery state, i.e., copper powders in the present invention, at a compaction ratio in a range of 20 to 40.

Figure 8:
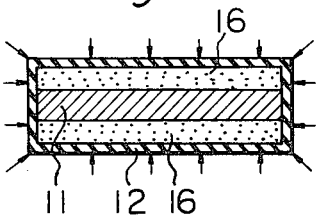

After the cladding component has filled the casing, the back-up metal box 13 is removed and the remaining entire body is subjected to a compaction utilizing static fluid pressure, i.e., hydrostatic pressure in the present embodiment, the pressure amounting to about 6,000 kg/cm$^2$ as shown in FIG. 8. By this application of the static fluid pressure compaction, the compaction ratio of the powdery cladding component 16 is raised to the one in a range of 80 to 90.

Figure 9:
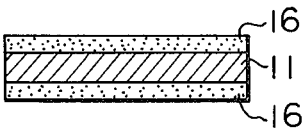

After completion of this compaction, the rubber casing 12 is removed as shown in FIG. 9 and the remaining entire body is then subjected to a thermal treatment at a temperature in a range of 500° to 1,000° C for about 1 to 20 hours. By this application of the thermal treatment, the compacted powdery cladding component 16, i.e., the compacted copper powders are sintered, and concurrent mutual diffusion at the border between the cladding and base components, i.e., between the nickel-base alloy base plate and the copper cladding powder takes place. After this application of the thermal treatment, the compaction ratio of the powdery copper cladding component amounts to 90 to 100 and the bonding between the nickel-base alloy and the powdery copper is remarkably fortified by the above-described mutual diffusion at the border between the two components.

Figure 10:
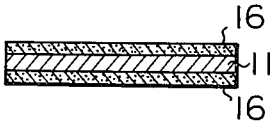

The clad metal plate so obtained is further processed by usual operations such as repeated rollings and thermal treatments in order to be shaped into a plate body of prescribed dimension such as shown in FIG. 10.

A further embodiment of the present invention is shown in FIGS. 11 through 13, in which the process of the present invention is applied to the production of multi-layered rod-shaped clad metal made up of a nickel-base alloy core, a copper inner sheath and an aluminum outer sheath.

To begin with, a clad metal rod body 20 such as shown in FIG. 11 is prepared by a process similar to the one shown in FIGS. 1 through 3. This clad metal rod body 20 is made up of a nickel-base alloy core component 21 and a copper sheath component 26 compactly embracing the former, the sheath component 26 becoming an inner sheath component in the end product, i.e., the multi-layered clad metal rod body.

Next, the material clad metal rod body 20 is encased and fixed in position within a rubber tube 22. The rubber tube 2 is covered with a back-up metal pipe 23, and the cylindrical space between the rod body 20 and the rubber tube 22 is filled up with aluminum 27 in a powdery state as shown in FIG. 12. The compaction ratio of this aluminum powder 27 is in a range of 20 to 40.

After removal of the back-up metal pipe 23, the entire body is subjected to a compaction utilizing static fluid pressure such as hydrostatic pressure at a pressure about 6,000 kg/cm$^2$. By this application of the static fluid pressure compaction, the compaction ratio of the powdery aluminum sheath component is raised up to the one in a range of 80 to 90 and the clad metal rod body so obtained assumes a transverse cross sectional profile of a multi-layered core-and-sheath configuration such as shown in FIG. 13. That is, the clad metal rod body is composed of the nickel-base alloy core component 21, the copper inner sheath component 26 embracing the core component and the aluminum outer sheath component 27 embracing the inner sheath component.

Next, the clad metal rod body is subjected to a thermal treatment at 300° to 650° C for 1 to 20 hours within a hydrogen atmosphere in order to cause sintering of the aluminum powders and concurrent mutual diffusion at the border between the copper inner sheath and aluminum outer sheath components and, concurrently, at the border between the nickel-base alloy core and the copper inner sheath components. This thermal treatment is followed by a series of usual processes such as repeated hydrostatic extrusions, heatings, drawings and swagings in order to obtain a multi-layered clad metal rod of prescribed dimension.

In case the inner sheath layer is to be made of a metal powder which is less compacted by application of the static fluid pressure, a modification can be applied to the process shown in FIGS. 11 through 13. In this case, the clad metal rod body 20 shown in FIG. 11 is subjected to a thermal treatment at 900° C for 4 hours within a hydrogen atmosphere for sintering of the copper powders and concurrent mutual diffusion at the border between the nickel-base alloy core and copper sheath components. This thermal treatment is followed by hydrostatic extrusion or drawing or swaging in order to reduce the diameter of the clad metal rod to a prescribed one.

The clad metal rod so obtained is then encased and fixed in position within a rubber tube 22 covered outwardly by a back-up metal 23 and, similar to the process shown in FIG. 12, a cylindrical space between the rod body 20 and the rubber tube 22 is filled with aluminum powder at a compaction ratio in a range of 20 to 40.

Then, after removal of the back-up metal pipe 23, compaction by static fluid pressure, such as hydrostatic pressure, is applied to the remaining entire body at a pressure about 6,000 kg/cm$^2$. The compacted clad metal rod is further subjected to processes similar to those used in the embodiment shown in FIGS. 11 through 13 in order to obtain an end product of prescribed dimension.

A further embodiment of the present invention is shown in FIGS. 14 through 16, in which the process of the present invention is applied to the production of a tubular clad metal made up of a nickle-base alloy core tube and a copper sheath tube.

A nickel-base alloy core tube 31 is prepared embracing an inner back-up metal rod 35, and the entire body so prepared is encased and fixed in position within a rubber tube 32. The rubber tube 32 is then covered by an outer back-up metal pipe 33 while leaving a cylindrical space 34 around the core tube 31 as shown in FIG. 14.

Next, the cylindrical space 34 is filled with copper powder at a compaction ratio from 20 to 40. After removal of the pipe 33, the remaining entire body is then subjected to compaction by static fluid pressure such as hydrostatic pressure as shown in FIG. 15, whereby the compaction ratio of the copper sheath component 36 is raised up to a range of 80 to 90 . Following the compaction step the back-up metal rod 35 is removed.

After application of thermal treatment for the sintering and the mutual diffusion a tubular clad metal such as shown in FIG. 16 is obtained, which is composed of a sintered nickel-base alloy core tube and a copper sheath 36 bonded to the former by mutual diffusion at the border. In the present embodiment, use of the inner back-up metal rod effectively prevents undesirable bending of the core tube during the compaction due to uneven filling-up of the powdery sheath component.

Following examples are illustrative of the present invention but are not to be construed as limiting the same.

EXAMPLE 1

Steel containing 0.05 to 0.50 carbon was used for the base material in combination with copper cladding material, the melting point temperature of the copper used being 1083° C. The hydrostatic pressure employed in the compaction was in a range of 1,500 to 12,000 kg/cm$^2$ and the compaction ratio of the powdery cladding material after compaction was in a range between 85 and 90. The thermal treatment was carried out within a dioxidizable atmosphere, such as a hydrogen atmosphere, at a temperature in a range from 500° to 1,000° C for about 1 to 20 hours. The compaction ratio after the thermal treatment was in a range between 95 and 100. The products obtained were advantageously used for electro-conductive springs and connectors for telephone systems.

EXAMPLE 2

Steel containing 0.05 to 0.50 carbon was used for the base material in combination with aluminum cladding material, the melting point temperature of the aluminum used being 660° C. The hydrostatic pressure employed in the compaction was over 3,000 kg/cm$^2$, and the compaction ratio of the powdery cladding material after the compaction was in a range between 90 and 95. The thermal treatment was carried out within a dioxidizable atmosphere such as a hydrogen atmosphere at a temperature in a range of 350° to 630° C for about 1 to 20 hours. The compaction ratio after the thermal treatment was in a range between 95 and 100. The products were advantageously used for plates of vacuum tubes.

EXAMPLE 3

Aluminum was used for the base material in combination with copper cladding material. The hydrostatic pressure employed in the compaction was in a range of 3,000 to 12,000 kg/cm$^2$, and the compaction ratio of the powdery cladding material after the compaction was in a range between 85 and 90. The thermal treatment was carried out in an atmosphere similar to the one in the foregoing examples at a temperature in a range of 400° to 530° C for about 1 to 20 hours. The compaction ratio after the thermal treatment was in a range between 95 and 100. The products were advantageously used for connectors and electric lead wires.

EXAMPLE 4

Fe-Ni alloy was used for the base material in combination with copper cladding material, the melting point temperature of the alloy used being 1,440° C. The hydrostatic pressure employed in the compaction was in a range of 3,000 to 12,000 kg/cm$^2$ and the compaction ratio of the powdery cladding material after the compaction was in a range between 85 and 90. The thermal treatment was carried out in an atmosphere similar to the one in the foregoing examples at a temperature in a range from 500° to 1,000° C for about 1 to 20 hours. The compaction ratio after the thermal treatment was in a range between 95 and 100. The products were advantageously used for lead wires to be partly embedded in soft glasses in vacuum tubes.

EXAMPLE 5

Magnesium (Mg) was used for the base material in combination with silver (Ag) claddng material, the melting point temperatures being 650° C for the magnesium used and 960.8° C for the silver used, respectively. The hydrostatic pressure employed in the compaction was in a range of 1,500 to 20,000 kg/cm$^2$, and the compaction ratio of the powdery cladding material after the compaction was in a range between 85 and 90. The thermal treatment was performed in a dioxidizable atmosphere at a temperature in a range of 300° to 600° C for about 1 to 20 hours. The compaction ratio of the cladding material after the thermal treatment was in a range between 95 and 100. The products obtained were advantageously used for electrodes of batteries.

EXAMPLE 6

Type 2024 high-strength aluminum alloy was used for the base material in combination with type 6053 corrosion-resistant aluminum alloy cladding material, the melting point temperature for the alloy used being in a range from 620° to 660° C. Compaction was carried out at a hydrostatic pressure in a range from 1,500 to 20,000 kg/cm$^2$ and the compaction ratio of the powdery cladding material was raised up to a range between 85 and 95. The thermal treatment was carried out in a dioxizable atmosphere at a temperature in a range of 300° to 630° C for about 1 to 20 hours. The compaction ratio of the cladding material after the thermal treatment was in a range between 95 and 100. The products obtained were advantageously used for aircraft parts owing to their high strength combined with excellent resistance against corrosion.

EXAMPLE 7

Type 5052 aluminum alloy of a melting point temperature in a range between 620° and 660° C was used for the base material and copper was used for the cladding material. Compaction was carried out at a hydrostatic pressure over 3,000 kg/cm$^2$, and the compaction ratio of the powdery cladding material was raised up to a range between 85 and 95. The thermal treatment was carried out in a dioxidizable atmosphere at a temperature in a range of 300° to 630° C for about 1 to 20 hours. The resultant compaction ratio of the cladding material was in a range between 95 and 100. The obtained products were advantageously used for microwave transmission tubes.

EXAMPLE 8

Copper-beryllium alloy having a melting point temperature of about 1,000° C was used for the base material in combination with copper cladding material. Compaction was carried out at a hydrostatic pressure in a range of 3,000 to 12,000 kg/cm$^2$ and the resultant compaction ratio of the powdery cladding material was in a range between 85 and 90. Thermal treatment was carried out in a dioxidizable atmosphere at a temperature in a range of 500° to 1,000° C for about 1 to 20 hours. The resultant compaction ratio of the cladding material was in a range of 95 to 100. The obtained products were advantageously used for electro-conductive springs.

EXAMPLE 9

Austenite-type stainless steel (Cr 18 – 24, Ni 8 – 20, Fe Balance) of a melting point temperature in a range of 1,480° to 1,505° C was used for the base material, and cupro-nickel (Cu 70 – 90, Ni 30 – 10) having a melting point temperature in a range of 880° to 950° C was used for the cladding material. Compaction was carried out at a hydrostatic pressure over 3,000 kg/cm$^2$ and the resultant compaction ratio of the powdery cladding material was about 85 to 86. The thermal treatment was carried out in a dioxidizable atmosphere at a temperature in a range between 500° and 1,000° C for about 1 to 20 hours. The resultant compaction ratio of the cladding material was about 98 to 100. The products so obtained were used for submarine cables.

EXAMPLE 10

Copper phosphate of a melting point temperature in a range from 880° to 950° C was used for the base material in combination with silver cladding material. Compaction was carried out at a hydrostatic pressure over 3,000 kg/cm$^2$ and the resultant compaction ratio of the powdery cladding material was in a range between 85 to 90. The thermal treatment was carried out in a non-oxidizable atmosphere, such as an argon or nitrogen atmosphere, at a temperature between 400° and 920° C for about 1 to 20 hours. The resultant compaction ratio of the cladding material was in a range of 97 to 100. The product obtained was advantageously used for springs for electric contacts.

EXAMPLE 11

Copper was used for the base material and nickel having a melting point temperature of 1,453° C was used for the cladding material. Compaction was carried out at a hydrostatic pressure in a range of 3,000 to 12,000 kg/cm$^2$ and the resultant compaction ratio of the cladding material was in a range between 85 and 90. Thermal treatment was carried out in a non-oxidizable atmosphere, such as argon or nitrogen atmosphere, at a temperature in a range of 500° to 1,000° C for about 1 to 20 hours. The resultant compaction ratio of the cladding material was in a range of 95 to 100. The products so obtained were advantageously used for connections in electric circuits used under high temperature conditions.

EXAMPLE 12

Copper was used for the base material and silver was used for the cladding material. The compaction was carried out with a static inert gas such as argon gas at a pressure over 3,000 kg/cm$^2$, and the resultant compaction ratio of the powdery cladding material was in a range of 85 to 90. Thermal treatment was carried out in a vacuum of $10^{-2}$ to $10^{-6}$ torr at a temperature in a range between 400° and 920° C for about 1 to 20 hours. The compaction ratio of the cladding material after the thermal treatment was in a range of 97 to 100, and the products so obtained were advantageously used for lead wires for transistors.

EXAMPLE 13

Stainless steel was used for the base material which was sandwiched by copper cladding material layers. Compaction was carried out at a static inert gas pressure in a range of 3,000 to 12,000 kg/cm$^2$ and the resultant compaction ratio of the powdery cladding material was in a range between 85 and 90. Thermal treatment was carried out in a non-oxidizable atmosphere, such as an argon or nitrogen atmosphere, at a temperature in a range of 500° to 1,000° C for about 1 to 20 hours, and the resultant compaction ratio of the cladding material was in a range between 95 and 100. The products so obtained were advantageously used for ornaments.

EXAMPLE 14

Stainless steel was used for the base material and copper was used for the cladding material. The compaction was carried out at a static inert gas pressure in a range of 3,000 to 12,000 kg/cm$^2$, and the resultant compaction ratio of the powdery cladding material was in a range between 85 and 90. The thermal treatment was carried out in a dioxidizable atmosphere at a temperature in a range of 500° to 1,000° C for about 1 to 20 hours. The resultant compaction ratio of the cladding material was in a range of 95 to 100 and the products so obtained were advantageously used for tableware.

As is well understood from the foregoing explanation, use of the cladding material substantially in the powdery state increases the total surface area reactive in the sintering and diffusion, while employment of the static fluid pressure in the compaction assures uniform application of the compaction pressure, resulting in a uniform and enhanced compaction ratio (density) of the cladding material in the end products.

What is claimed is:

1. Process for producing clad metals comprising, in sequential combination, covering a surface of a base material with a cladding material substantially in a powdery state, binding said cladding material and said base material by compaction under static fluid pressure in order to obtain a laminated body, and raising the temperature of said laminated body to a sintering temperature of said base material and cladding material, thereby resulting in mutual diffusion at the border between said materials, combinations of said cladding material and core material being chosen from a member selected from the group consisting of nickel base alloy with copper, nickel base alloy with aluminum, steel containing carbon with copper, steel containing carbon with aluminum, aluminum with copper, Fe-Ni alloy with copper, magnesium with silver, type 2024 high-strength aluminum alloy with type 6053 corrosion-resistant aluminum alloy, type 5052 aluminum alloy with copper, copper-beryllium alloy with copper, austenite-type stainless steel with cupro-nickel, copper phosphate with silver, copper with nickel, copper with silver, and stainless steel with copper, the core material being the first-mentioned metallic material of each member of the group and the cladding material being the second-mentioned metallic material of each member of the group.

2. Process for producing clad metals as claimed in claim 1, in which hydrostatic pressure is used for said compaction.

3. Process for producing clad metals as claimed in claim 1, in which static inert gas pressure is used for said compaction.

4. Process for producing clad metals as claimed in claim 1, in which said compaction is carried out at a static fluid pressure in a range of 1,500 to 20,000 kg/cm$^2$.

5. Process for producing clad metals as claimed in claim 1, in which said temperature is lower by 50° to 500° C than the lower melting point of either of said materials.

6. Process for producing clad metals as claimed in claim 1, further comprising maintaining said raised temperature for 1 to 20 hours.

7. Process for producing clad metals as claimed in claim 1, in which said step of raising said temperature is carried out in a deoxidizable atmosphere.

8. Process for producing clad metals as claimed in claim 1, in which the step of raising said temperature is carried out in a non-oxidizable atmosphere.

9. Process for producing clad metals as claimed in claim 1, in which the step of raising said temperature is carried out in a vacuum.

10. Process for producing clad metals as claimed in claim 9, in which the degree of vacuum is in a range from $10^{-2}$ to $10^{-6}$ torr.

11. Process for producing clad metals as claimed in claim 1, in which said base material is in the form of a circular rod core further comprising the steps of forming a confined cylindrical space around said rod core, and filling said space with said cladding material prior to said binding step.

12. Process for producing clad metals as claimed in claim 11, in which the compaction ratio of said cladding material within said space is in a range of 20 to 40.

13. Process for producing clad metals as claimed in claim 1, in which said base material is in the form of a substantially flat plate further comprising the steps of forming a confined space on a side of said cladding material, and filling said space with said powdered cladding material prior to binding said materials.

14. Process for producing clad metals as claimed in claim 13, in which the compaction ratio of said cladding material is in a range of 20 to 40.

15. Process for producing clad metals as claimed in claim 13, in which the step of forming said space comprises the step of surrounding said side of said base material with a rubber casing, which should be removed and removing said casing after said compaction.

16. Process for producing clad metals as claimed in claim 15, further comprising the steps of covering said rubber casing with a back-up metal box, and removing said back-up metal box after said step of filling said space with said cladding material.

17. A process according to claim 1, comprising the additional steps of covering said laminated body with a further metallic cladding material, binding by compaction under static fluid pressure said further cladding material with said first cladding material in order to obtain a multi-laminated body, and raising the temperature of said multi-lamintated body to a sintering temperature of said base material and said cladding materials, thereby resulting in mutual diffusion at the borders between said materials.

18. Process for producing clad metals as claimed in claim 17, in which said base material is in the form of a core tube, further comprising the steps of forming a confined cylindrical space around said core tube, and filling said confined cylindrical space formed around said tube with said further cladding material.

19. Process for producing clad metals as claimed in claim 18, in which compaction ratio of said further cladding material is in a range of 20 to 40.

20. Process for producing clad metals as claimed in claim 18, in which the step of forming said cylindrical space comprises the step of surrounding said core tube with a rubber tube, having an internal diameter greater than the external diameter of said core tube, and removing said rubber tube after said compaction.

21. Process for producing clad metals as claimed in claim 18, further comprising the step of inserting a back-up metal rod snugly into said core tube, covering said rubber tube with a back-up metal pipe, and removing said back-up metal rod after said cladding materials have filled said confined spaces.

22. A process for producing clad materials comprising, in sequential combination, covering a surface of a metallic base material comprising a nickel-base alloy with a first metallic cladding material comprising copper substantially in a powdery state, binding said first cladding material and said base material by compaction under static fluid pressure in order to obtain a laminated body, raising the temperature of said laminated body to a sintering temperature of said base material and said first cladding material, thereby resulting in mutual diffusion at the border between said materials, covering said thermally treated laminated body with a further metallic cladding material comprising aluminum substantially in a powdered state, binding by compaction under static fluid pressure said further cladding material with said first cladding material in order to obtain a multi-laminated body, and raising the temperature of said multi-laminated body to a sintering temperature of said first cladding material and said further cladding material.

23. A process for producing clad metals, comprising the steps of, in sequential combination, disposing a solid metallic base material within a surrounding resilient enclosure, filling the space between said base material and said enclosure with a powder comprising a cladding material, applying hydrostatic pressure to the exterior surface of said enclosure to compress said cladding material against said base material, thus binding said cladding material and said base material by compaction to form a laminated body, removing said resilient enclosure, and raising the temperature of said laminated body to a sintering temperature of said base material and cladding material, for a sufficient time to cause mutual diffusion at the border between said materials, combinations of said cladding material and base material being chosen from a member selected from the group consisting of nickel base alloy with copper, nickel base alloy with aluminum, steel containing carbon with copper, steel containing carbon with aluminum, aluminum with copper, Fe-Ni alloy with copper, magnesium with silver, type 2024 high-strength aluminum alloy with type 6053 corrosion-resistant aluminum alloy, type 5052 aluminum alloy with copper, copper-beryllium alloy with copper, austenite-type stainless steel with cupro-nickel, copper phosphate with silver, copper with nickel, copper with silver, and stainless steel with copper, the base material being the first-mentioned metallic material of each member of the group and the cladding material being the second-mentioned metallic material of each member of the group.

24. A process for producing clad metals as claimed in claim 23, wherein said enclosure comprises a rubber tube, further comprising covering said rubber tube with a back-up metal pipe having an internal diameter substantially equal to the external diameter of said rubber tube, and removing said metal pipe after said cladding material fills said tube and before the step of sintering said cladding material and said base material.

* * * * *

UNITED STATES PATENT OFFICE

CERTIFICATE OF CORRECTION

Patent No. 4,090,873 Dated May 23,1978

Inventor(s) Masayuki Takamura, et al

It is certified that error appears in the above-identified patent and that said Letters Patent are hereby corrected as shown below:

Column 1, line 4: "division" should be deleted.

Column 3, line 43: "intering" should be --sintering--.

Column 7, line 31-32: "dioxizable" should be --dioxidizable--.

Column 10, line 50: "lamintated" should be --laminated--.

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*